US009184522B1

(12) United States Patent
Savoy et al.

(10) Patent No.: US 9,184,522 B1
(45) Date of Patent: Nov. 10, 2015

(54) LATCH APPARATUS FOR RETAINING A FLEXIBLE CIRCUIT CABLE WITHIN A RECEPTACLE MOUNTED ON A CIRCUIT BOARD

(71) Applicant: XEROX CORPORATION, Norwalk, CT (US)

(72) Inventors: Matthew D. Savoy, Webster, NY (US); Glenn M. Keenan, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 41 days.

(21) Appl. No.: 14/261,486

(22) Filed: Apr. 25, 2014

(51) Int. Cl.
*H01R 12/57* (2011.01)
*H01R 12/79* (2011.01)
*H01R 12/77* (2011.01)

(52) U.S. Cl.
CPC ..... *H01R 12/79* (2013.01); *H01R 12/774* (2013.01)

(58) Field of Classification Search
CPC .... H01R 12/57; H01R 12/772; H01R 12/774; H01R 13/426; H01R 13/627; H01R 4/48
See application file for complete search history.

(56) References Cited

U.S. PATENT DOCUMENTS

| | | | | |
|---|---|---|---|---|
| 4,687,276 | A | 8/1987 | Stockmaster | |
| 5,906,501 | A | 5/1999 | Longueville et al. | |
| 5,928,029 | A | 7/1999 | Lam | |
| 6,568,955 | B2 | 5/2003 | Hotea et al. | |
| 6,586,681 | B2 | 7/2003 | Adams et al. | |
| 6,875,047 | B2 | 4/2005 | Ueda | |
| 6,939,166 | B2 * | 9/2005 | Chung | 439/495 |
| 7,083,459 | B1 * | 8/2006 | Wu et al. | 439/354 |
| 7,281,938 | B1 * | 10/2007 | Wu | 439/353 |
| 7,473,125 | B2 | 1/2009 | Murakami | |
| D593,037 | S | 5/2009 | Shien-Tang | |
| 7,534,139 | B2 | 5/2009 | Andre et al. | |
| D593,491 | S | 6/2009 | Liu et al. | |
| D594,825 | S | 6/2009 | Sweeney et al. | |
| D606,025 | S | 12/2009 | Cheng et al. | |
| 7,883,377 | B2 * | 2/2011 | Cheng | 439/736 |
| D643,368 | S | 8/2011 | Zhang et al. | |

(Continued)

FOREIGN PATENT DOCUMENTS

EP 1 439 611 B1 6/2006

OTHER PUBLICATIONS

Notice of Allowance Communication, U.S. Appl. No. 29/488,983, Date: Oct. 24, 2014, pp. 1-12.

*Primary Examiner* — Truc Nguyen
(74) *Attorney, Agent, or Firm* — Gibb & Riley, LLC

(57) ABSTRACT

A latch apparatus for retaining a flexible circuit cable within a receptacle mounted on a circuit board comprises a latch body having a second planar side comprising opposing alignment pins positioned at a first edge and a second edge of the body. A second end of the body comprises alignment protrusions extending from the second end in a first direction. The second end also comprises clamping protrusions extending from the second end in the first direction. The clamping protrusions are a distance from the alignment protrusions equal to a thickness of the circuit board. A latch member extends from the second end. The latch member comprises a linear clip surface extending from the latch in a direction perpendicularly away from the second planar side, and the linear clip surface runs in a second direction and has a length less than a width of the receptacle.

20 Claims, 6 Drawing Sheets

(56) References Cited

U.S. PATENT DOCUMENTS

| | | | | |
|---|---|---|---|---|
| 8,221,147 | B2 | 7/2012 | Ozeki | |
| 2005/0020125 | A1* | 1/2005 | Huang | 439/495 |
| 2005/0277325 | A1* | 12/2005 | Yin et al. | 439/499 |
| 2008/0188115 | A1* | 8/2008 | Watanabe | 439/353 |
| 2008/0214043 | A1* | 9/2008 | Ko | 439/494 |
| 2013/0012071 | A1 | 1/2013 | Nakazura et al. | |
| 2013/0231002 | A1* | 9/2013 | Yokoo | 439/372 |
| 2013/0316587 | A1 | 11/2013 | Takahashi et al. | |

* cited by examiner

LATCH APPARATUS FOR RETAINING A FLEXIBLE CIRCUIT CABLE WITHIN A RECEPTACLE MOUNTED ON A CIRCUIT BOARD

BACKGROUND

Systems and methods herein generally relate to a latch apparatus, and more particularly to a latch apparatus for retaining a flexible circuit cable within a receptacle mounted on a circuit board.

Flexible circuit cables are used extensively in modern electronic devices to provide signal and power connections. Such cables are generally very flat (having a cable width that is much larger relative to the cable thickness). Such flexible circuit cables often maintain separate wires insulated from, and running parallel to, one another with conductive connectors for each of the wires electrically insulated from one another at the ends of the cable.

Low insertion force (LIF) connectors are often used as electronic receptors for such flexible circuit cables because they enable very low insertion forces. More specifically, low insertion force connectors maintain an electrical contact corresponding to each of the conductive connectors at the ends of the flexible circuit cable, and generally have a slot opening that has a thickness approximately equal to (or just slightly larger than) the flexible circuit cable to allow the flexible circuit cable to fit snugly within the slot opening. Such low insertion force connectors utilize frictional forces between the slot and the conductive connectors at the end of the flexible circuit cable to maintain the flexible circuit cable within the slot opening of the low insertion force connector.

In one example, print heads commonly utilize two flexible circuit cables to transmit electrical signals from the head interface control (HIC) board and wave amplifier boards within the print box controller (PBU) to the print head. At the print head, each flexible circuit cable is inserted into separate low insertion force connector soldered to the master printed wire board assembly (PWBA) on the print head. Once inserted within a slot on the low insertion force connectors, the flexible circuit cables are retained in place by frictional forces generated from a light clamping force applied to the thickness of the flexible circuit cables from electrical leads within the low insertion force connectors.

However, in order to make it easy for the user to insert the flexible circuit cable into the low insertion force connectors, sometimes the slot is sized to have a thickness that is large enough to generate low frictional retention forces. If the retention forces are low enough, this can create a substantial risk to physical damage to the device to which the cable is attached due to unintentional cable skew or removal. Therefore, due to the low cable insertion forces enabled by utilization of low insertion force connectors, cable retention force can be compromised.

High retention forces are useful in preventing the flexible circuit cable from inadvertently becoming skewed relative to, or completely decoupled from, the low insertion force connector. In one example, an inkjet printer can utilize 56 print heads with two flexible circuit cables per head, which yields 112 opportunities for failure at this interface, which could result in crossed leads and extensive physical damage to the print head or head interface control and wave amplifier boards within the print box controller.

SUMMARY

Summarized here is an exemplary latch apparatus for retaining a flexible circuit cable within a receptacle mounted on a circuit board. The latch apparatus includes a latch body having a first planar side opposite a second planar side. The first planar side is parallel to the second planar side. The first planar side and second planar side are planar between a first end and a second end in a first direction, and are planar between a first edge and a second edge in a second direction perpendicular to the first direction. The first direction and the second direction are parallel to the first planar side and the second planar side.

The first end includes a first handle extending perpendicularly from the first planar side. Pressure applied to the first handle moves the body in the first direction and in a direction opposite the first direction to move the body toward and away from the circuit board and the receptacle. The second planar side includes opposing alignment pins positioned at the first edge and the second edge of the second planar side. The alignment pins are maintained within circular notches of the flexible circuit cable.

The second end includes alignment protrusions that extend from the second end in the first direction. The alignment protrusions extend from the second end at the first edge and the second edge and are parallel to the first edge and the second edge. The alignment protrusions are spaced apart from one another at a first spacing greater than a width of the flexible circuit cable. The first spacing is equal to (or slightly larger than) the width of the receptacle. The alignment protrusions fit against sides of the receptacle to maintain the body centered with respect to the receptacle.

The second end also includes clamping protrusions that extend from the second end in the first direction. The clamping protrusions extend from the second end at the first edge and the second edge and are parallel to the first edge and the second edge. The clamping protrusions include clamping protrusion extensions that extend from the second planar side. The clamping protrusion extensions position the clamping protrusions a distance from the alignment protrusions that is equal to the thickness of the circuit board. The clamping protrusions are biased in a direction toward the alignment protrusions to clamp the circuit board between the clamping protrusions and the alignment protrusions.

Further, a latch member extends from the second end. The latch member includes a second handle that extends from the latch in a direction perpendicularly away from the first planar side. The latch member includes a linear clip surface that extends from the latch member in a direction perpendicularly away from the second planar side. The linear clip surface runs in the second direction and has a length less than the width of the receptacle. A contact end of the flexible circuit cable is positioned to extend toward the second end of the body. The contact end of the flexible circuit cable is maintained within the receptacle by the linear clip surface clipping against the receptacle. The linear clip surface clips against the receptacle to oppose forces opposite to the first direction. Pressure on the second handle moves the linear clip surface in the direction perpendicularly away from the first planar side, or more accurately the second handle moves the linear clip surface in an arc as the latch member pivots about a line in the second direction at the second end of the latch body. To remove the latch apparatus, a pinching motion is made between the first handle and second handle in conjunction with applying pressure to the second handle in a direction opposite the first direction.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, high retention forces are useful in preventing the flexible circuit cable from inadvertently becoming skewed relative to, or completely decoupled from, the low insertion force connector which could result in extensive physical damage to the print head or head interface control and wave amplifier boards within the print box controller.

Figure 2:
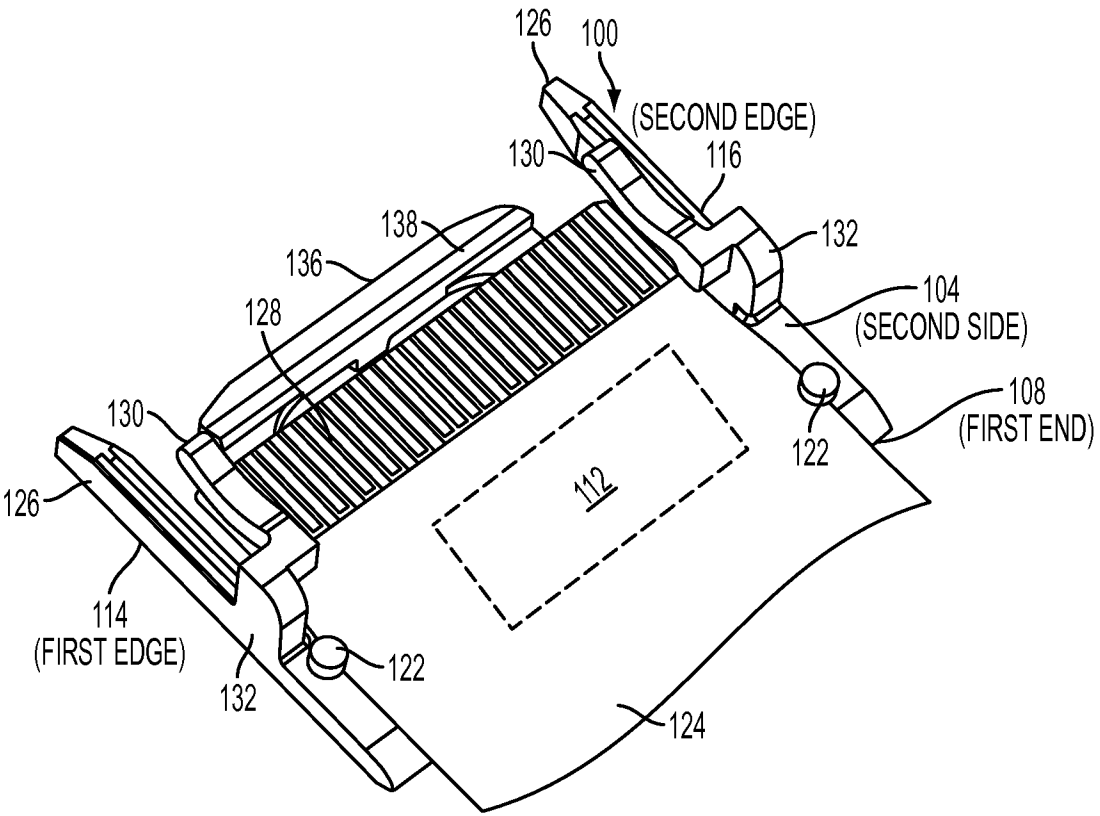
FIG. 2 is a schematic perspective diagram illustrating and opposing side of devices herein.
Figure 3:
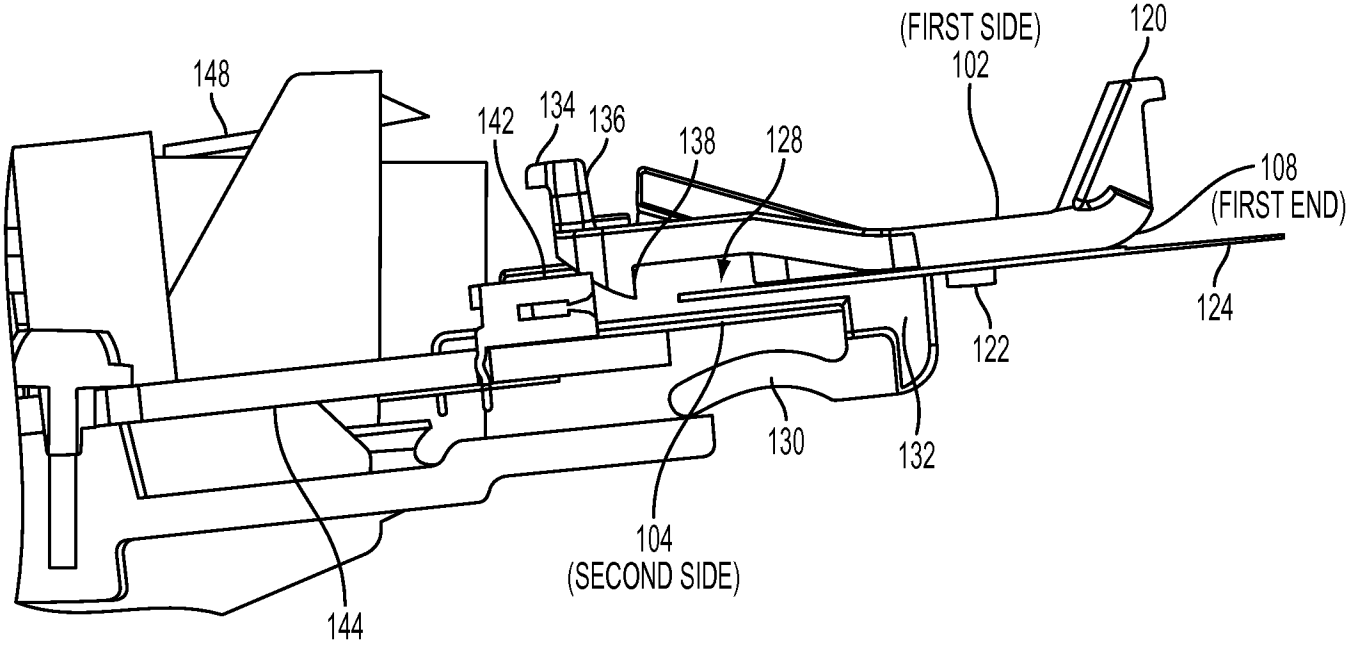
FIG. 3 is a schematic diagram illustrating a side view of devices herein.
Figure 4:
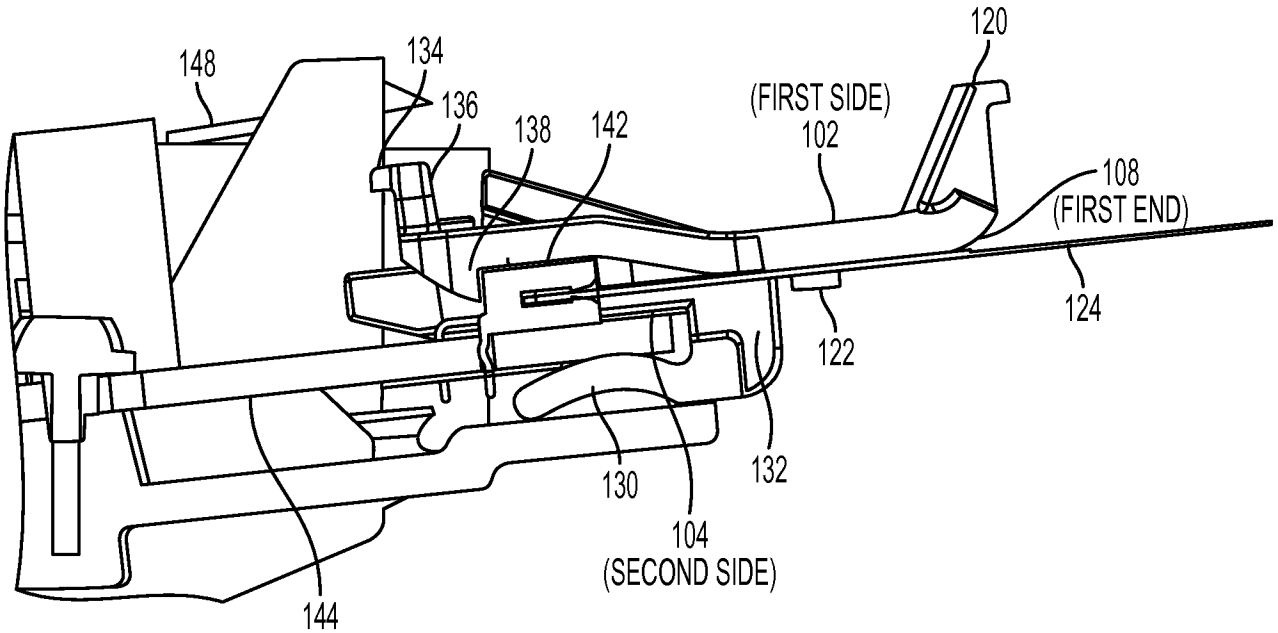
FIG. 4 is a schematic diagram illustrating a side view of devices herein.

Therefore, as shown in FIGS. 1-5, the systems and methods herein provide a latching structure. More specifically, FIGS. 1-5 show different schematic views of the same exemplary latch apparatus for retaining a flexible circuit cable 124 within a receptacle 142 mounted on a circuit board 144. As shown in FIG. 4, the circuit board 144 can be part of a larger structure 148 that can comprise, for example, a marking material supply cartridge (such as an inkjet cartridge, a toner cartridge, a dry ink cartridge, etc.).

The latch apparatus includes a latch body 100 have a first planar side 102 opposite a second planar side 104. The first planar side 102 is parallel to the second planar side 104. The first planar side 102 and second planar side 104 are planar between a first end 108 and a second end 110 in a first direction, and are planar between a first edge 114 and a second edge 116 in a second direction perpendicular to the first direction. The first direction and the second direction are parallel to the first planar side 102 and the second planar side 104.

Figure 1:
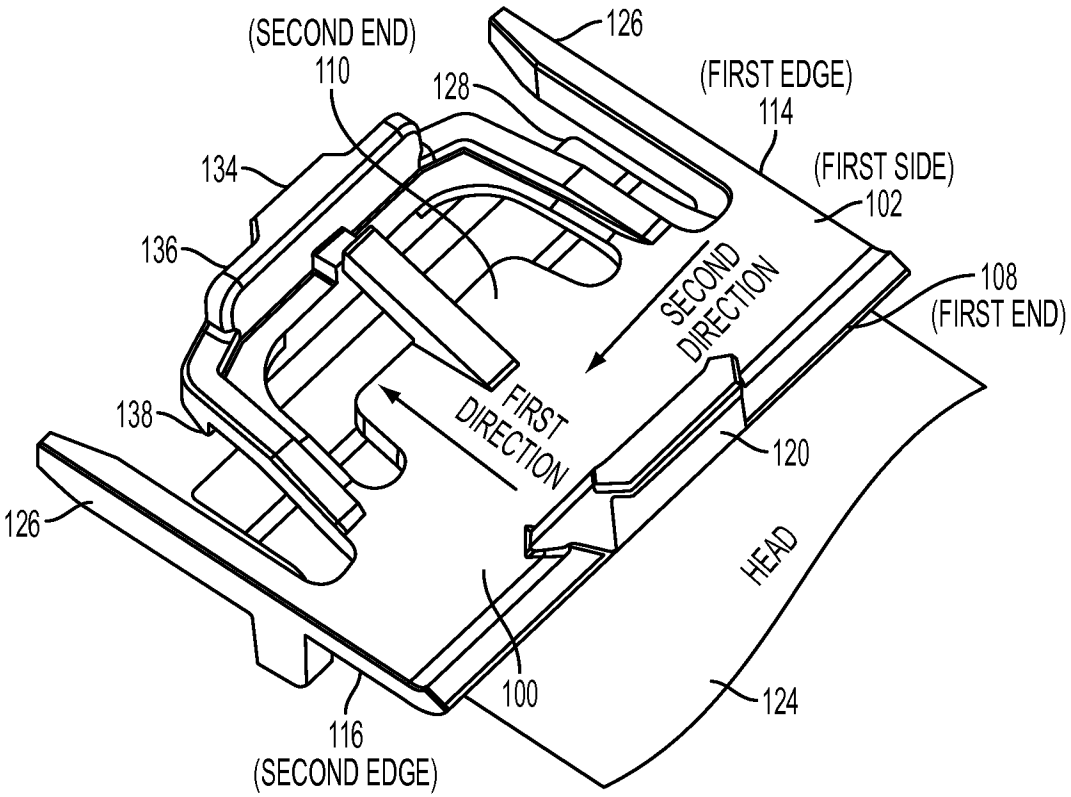
FIG. 1 is a schematic perspective diagram illustrating a first side of devices herein.

As shown in FIG. 1, the first end 108 includes a first handle 120 that extends perpendicularly from the first planar side 102. Pressure applied to the first handle 120 moves the body 100 in the first direction and in a direction opposite the first direction to move the body 100 toward and away from the circuit board 144 and the receptacle 142.

As shown in FIG. 2, the second planar side 104 includes opposing alignment pins 122 positioned at the first edge 114 and the second edge 116 of the second planar side 104. The alignment pins 122 are maintained within circular notches of the flexible circuit cable 124. Spacing between the pins in the second direction is effectively equal to the spacing between the circular notches of the flexible circuit cable in the second direction. Further a two-sided pressure sensitive adhesive pad (shown in transparent view using dashed lines as item 112 in FIG. 2) is positioned between the flexible circuit cable 124 and the second side 104 of the body 100 to fixedly mount the flexible circuit cable 124 to the second side 104 of the body 100.

The second end 110 includes alignment protrusions 126 that extend from the second end 110 in the first direction. The alignment protrusions 126 extend from the second end 110 at the first edge 114 and the second edge 116 and are parallel to the first edge 114 and the second edge 116. The alignment protrusions 126 are spaced apart from one another at a first spacing greater than a width of the flexible circuit cable 124 to allow the flexible circuit cable 124 to pass between the alignment protrusions 126. In addition, the first spacing between the alignment protrusions 126 is approximately equal to (or only slightly (e.g., within 1-3%) larger or smaller than) a width of the receptacle 142. This allows the alignment protrusions 126 to fit snugly against sides of the receptacle 142 to maintain the body 100 centered with respect to the receptacle 142 when attached thereto (see the attached position shown in FIG. 4).

The second end 110 also includes clamping protrusions 130 that extend from the second end 110 in the first direction (and are therefore parallel to the alignment protrusions 126). The clamping protrusions 130 extend from the second end 110 at the first edge 114 and the second edge 116 and are parallel to the first edge 114 and the second edge 116. The clamping protrusions 130 include clamping protrusion extensions 132 that extend from the second planar side 104. The clamping protrusion extensions 132 position the clamping protrusions 130 a distance from the alignment protrusions 126 that is equal to (or only slightly (e.g., within 10%) larger or smaller than) the thickness of the circuit board 144. The clamping protrusions 130 are biased in a direction toward the alignment protrusions 126 to clamp the circuit board 144 between the clamping protrusions 130 and the alignment protrusions 126 when attached thereto (see the attached position shown in FIG. 4).

Further, a latch member 136 extends from the second end 110. The latch member 136 includes a second handle 134 that extends from the latch in a direction perpendicularly away from the first planar side 102. The latch member 136 includes a linear clip surface 138 that extends from the latch in a direction perpendicularly away from the second planar side 104. The linear clip surface 138 runs in the second direction and has a length less than the width of the receptacle 142, and can be, for example 66%, 70%, 90%, etc., the width of the receptacle 142.

A contact end 128 of the flexible circuit cable 124 is positioned to extend toward the second end 110 of the body 100. The contact end 128 of the flexible circuit cable 124 is maintained within the receptacle 142 by the linear clip surface 138 clipping against the receptacle 142 when the body 100 is fully inserted over the circuit board 144 and receptacle 142 in the first direction (which is shown when the body 100 is moved from the position shown in FIG. 3 to the position shown in FIG. 4). More specifically, the linear clip surface 138 first contacts the receptacle 142 on the slot side as body 100 is presented to the circuit board 144 and the receptacle 142. Thus, the slot side of the receptacle 142 could be considered a first end of the receptacle 142 and the opposite side a second end of the receptacle 142. The linear clip surface 138 clips against this second end of the receptacle 142 when body 100 is fully inserted over the circuit board 144 and receptacle 142.

More specifically, as the body 100 is fully inserted over the circuit board 144 and the receptacle 142 as shown in FIG. 4, the angled surface of the linear clip surface 138 causes the linear clip surface 138 to ride over the first end of the receptacle 142 allowing the linear clip surface 138 to eventually rest against the opposite side (the second end) of the receptacle 142 to clip the linear clip surface 138 against the second end of the receptacle 142 and thereby oppose forces opposite to the first direction. The angled surface of the linear clip surface 138 is at an angle that is non-parallel and non-perpendicular to the plane of the first planar side 102 and the second planar side 104.

Pressure on the second handle 134 moves the linear clip surface 138 in the direction perpendicularly away from the first planar side 102, or more accurately the second handle 134 moves the linear clip surface 138 in an arc as the latch member 136 pivots about a line in the second direction at the second end 110 of the latch body 100. Therefore, as the first handle 120 and the second handle 134 are moved toward one another (such as when they are pinched together by the user squeezing the handles 120, 134 toward one another) the latch member 136 moves away from the circuit board 144. By squeezing the handles 120, 134 toward one another, this causes the latch member 136 and the clip surface 138 to be moved past the receptacle 142 to a distance from the circuit board 144 that is greater than the height of the receptacle 142. When the clip surface 138 is moved above the height of the receptacle 142, this allows the body 100 to be moved in a direction opposite the first direction (which withdraws the end 128 of the flexible circuit cable 124 from the receptacle 142).

Figure 5:
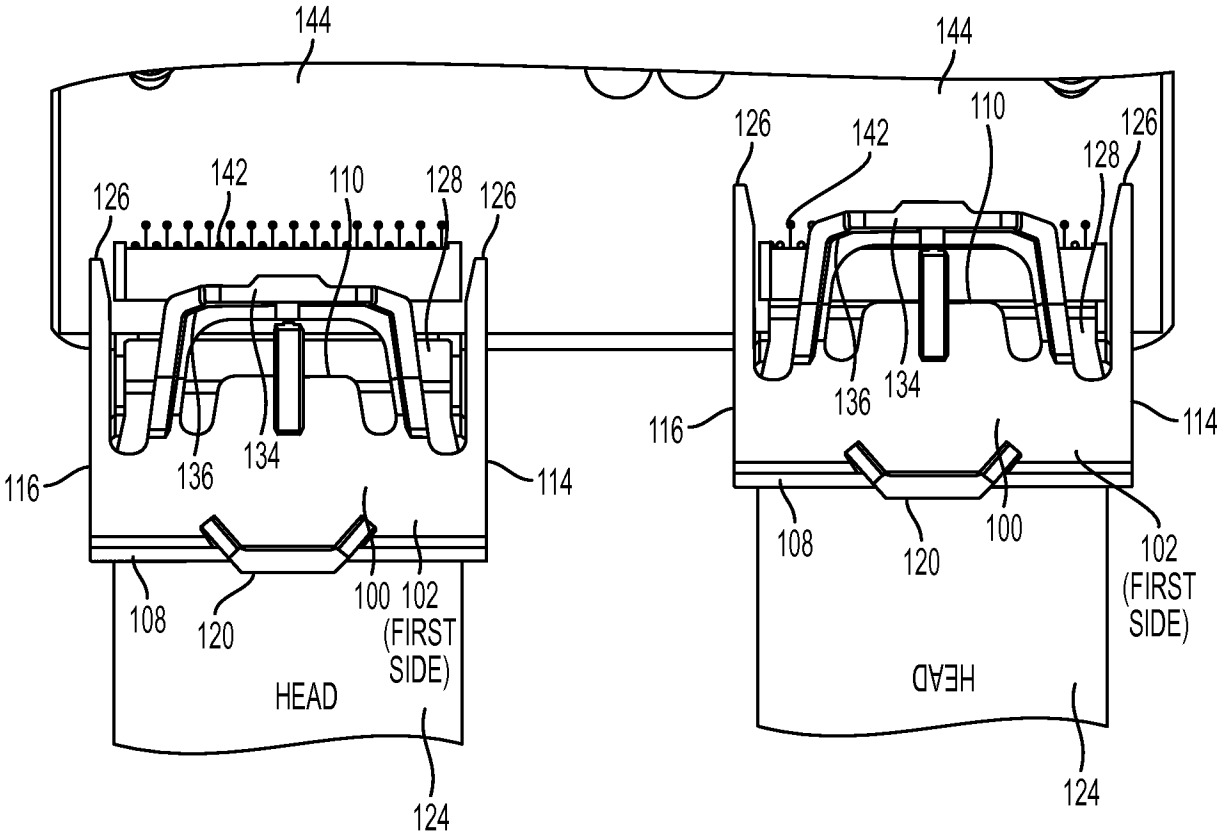
FIG. 5 is a schematic diagram illustrating a top view of devices herein.

FIG. 5 illustrates two of the latch is shown in Fingers 1-4. The latch on the left-hand side of FIG. 5 is shown as not being clipped onto the receptacle 142, while the latch on the right-hand side of FIG. 5 is shown as being clipped into the receptacle 142.

Therefore, as shown above, the latch herein comprises a plastic, metal, ceramic, alloy, etc., structure that is a retainer clip. The clip includes all elements shown in FIGS. 1-2 (except the flexible circuit cable 124, 128) and the clip is generally referred to here as a clip 100, for convenience (as the body 100 is generally considered to include all protruding elements). The clip 100 is rigidly coupled to a flexible circuit cable 124 (and can utilize a pressure sensitive adhesive 112 to help maintain the flexible circuit cable 124 connected to the latch). The retainer clip 100 is designed to latch over the low insertion force connector 142 on the print head master printed wire board assembly 144 as well as clamp onto the thickness of the master printed wire board assembly 144. These two functions enable a more robust and secure connection between the flexible circuit cable 124 and low insertion force connector 142.

As shown in FIGS. 1-5, the latch includes two long arms 126 extending from the main body 100. These arms 126 enable pre-alignment of the flexible circuit cable 124 to the low insertion force connector 142 prior to insertion. The latching mechanism of the clip 100 is wedge-shaped to lift and ride over the top of the low insertion force connector 142 and snap over the back edge of the low insertion force connector 142 after the flexible circuit cable 124 is fully inserted into the slot of the low insertion force connector 142. The curved, lower legs 130 effectively clamp the clip onto the printed wire board assembly 144 thickness and act as locators for positioning and aligning the clip relative to the flexible circuit cable 124.

The long arms 126 of the retainer clip 138 extend up to interface with the low insertion force connector 142 before the leading edge of the flexible circuit cable 124 as the latch is moved in the first direction. This enables lateral alignment of the flexible circuit cable 124 to the low insertion force connector 142. As the cable 124 is inserted further into the slots of the low insertion force connector 142 in the first direction, the low insertion force connector 142 effectively lifts that latching member of the retainer clip 100. Once the cable 124 is fully inserted into the slot of the low insertion force connector 142, the retainer clip 100 snaps down over the back edge of the low insertion force connector 142. The retainer clip 100 effectively prevents the cable 124 from becoming inadvertently skewed or decoupled from the low insertion force connector 142. With deliberate action, the user can easily remove the flexible circuit cable 124 and retainer clip 100 from the print head by supporting the first handle 120 with one finger, lifting the second handle 134 with another finger in a pinching motion and sliding the cable 124 out of the low insertion force connector 142 opposite the first direction.

FIG. 3 illustrates the top edge of the low insertion force connector 142 as it interfaces with the lead-in ramp of the retainer clip 100 latch member. In this view, the long arms 126 extend to either side of the low insertion force connector 142 to provide initial alignment of the flex cable 124 with the curved legs 130 of the clip resting on the top surface of the support bracket for the print head master printed wire board assembly 144/148. FIG. 4 shows the flex cable 124 fully inserted into the low insertion force connector 142 with the latching member securely over the back edge of the low insertion force connector 142. By design, the curved legs 130 interfere with the bottom surface of the print head master printed wire board assembly 144. This interference results in deformation of the curved legs 130 which provides sufficient clamping force to keep the retainer clip 100 connected to the back of the receptacle 142.

Figure 6:
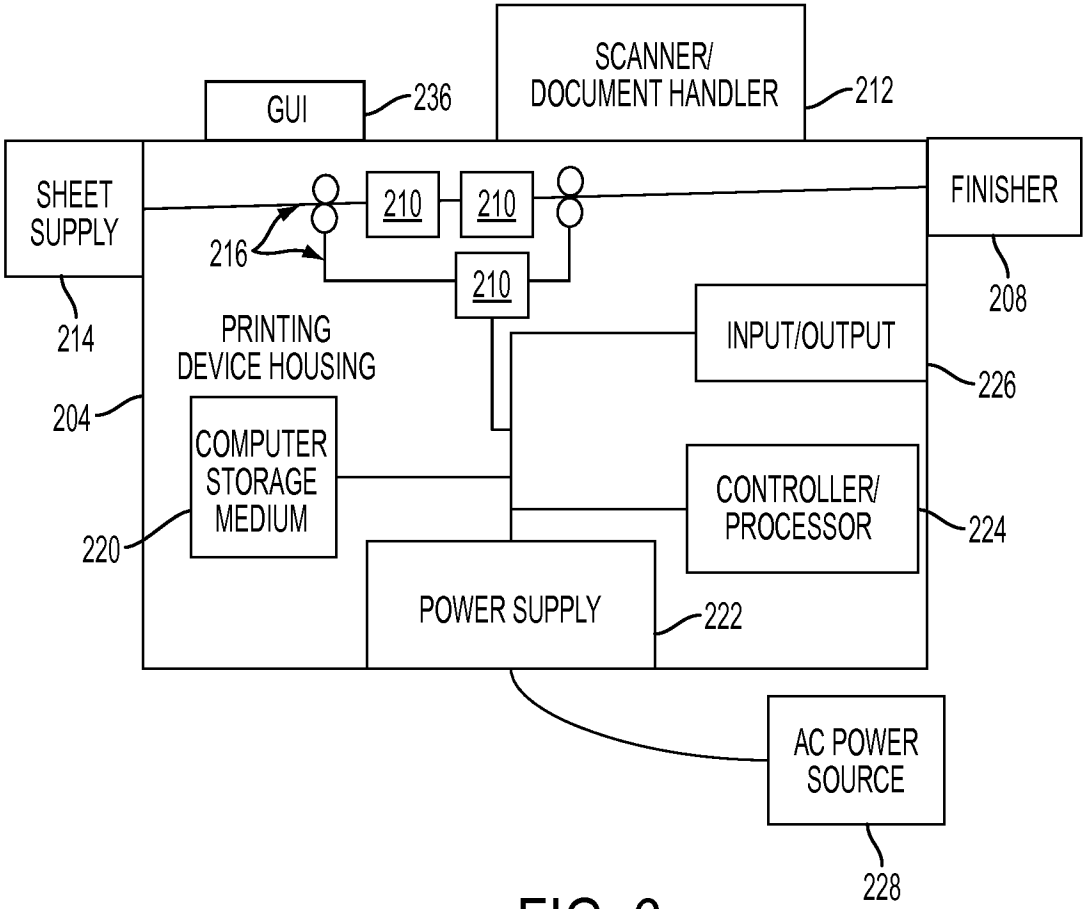
FIG. 6 is a schematic diagram illustrating devices herein.

FIG. 6 illustrates a printing device 204 that is a printing device 204, which can be used with systems and methods herein and can comprise, for example, a printer, copier, multi-function machine, multi-function device (MFD), etc. The printing device 204 includes a controller/processor 224 and a communications port (input/output) 226 operatively connected to the processor 224 and to the computerized network 202 external to the printing device 204. Also, the printing device 204 can include at least one accessory functional component, such as a graphic user interface assembly 236 that also operate on the power supplied from the external power source 228 (through the power supply 222).

The input/output device 226 is used for communications to and from the printing device 204. The processor 224 controls the various actions of the printing device 204. A non-transitory computer storage medium device 220 (which can be optical, magnetic, capacitor based, etc.) is readable by the processor 224 and stores instructions that the processor 224 executes to allow the printing device 204 to perform its various functions, such as those described herein. Thus, as shown in FIG. 6, a body housing has one or more functional components that operate on power supplied from an alternating current (AC) source 228 by the power supply 222. The power supply 222 can comprise a power storage element (e.g., a battery, etc).

The printing device 204 includes at least one marking device (printing engines) 210 operatively connected to the processor 224 using the latch and flexible circuit cable 124 shown in FIGS. 1-4, above. Further, a media path 216 positioned to supply sheets of media from a sheet supply 214 to the marking device(s) 210, etc. After receiving various markings from the printing engine(s), the sheets of media can optionally pass to a finisher 208 which can fold, staple, sort, etc., the various printed sheets. Also, the printing device 204 can include at least one accessory functional component (such as a scanner/document handler 212, etc.) that also operates on the power supplied from the external power source 228 (through the power supply 222).

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, processors, etc.) are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the systems and methods described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A latch apparatus for retaining a flexible circuit cable within a receptacle mounted on a circuit board, said latch apparatus comprising:

a latch body having a first planar side opposite a second planar side, said first planar side being parallel to said second planar side, said first planar side and second planar side being planar between a first end and a second end in a first direction and being planar between a first edge and a second edge in a second direction perpendicular to said first direction, said first direction and said second direction being parallel to said first planar side and said second planar side, said second planar side comprising opposing alignment pins positioned at said first edge and said second edge of said second planar side, said second end comprising alignment protrusions extending from said second end in said first direction, said second end comprising clamping protrusions extending from said second end in said first direction, said clamping protrusions being a distance from said alignment protrusions approximately equal to a thickness of said circuit board, a latch member extending from said second end, said latch member comprising a linear clip surface extending from said latch member in a direction perpendicularly away from said second planar side, and said linear clip surface running in said second direction and having a length less than a width of said receptacle.

2. The latch apparatus according to claim 1, said clamping protrusions being biased in a direction toward said alignment protrusions to clamp said circuit board between said clamping protrusions and said alignment protrusions.

3. The latch apparatus according to claim 1, said linear clip surface clipping against said receptacle to opposed forces opposite to said first direction.

4. The latch apparatus according to claim 3, a contact end of said flexible circuit cable being positioned to extend toward said second end of said body, said contact end of said flexible circuit cable being maintained within said receptacle by said linear clip surface clipping against said receptacle.

5. The latch apparatus according to claim 1, said alignment pins being maintained within circular notches of said flexible circuit cable.

6. The latch apparatus according to claim 1, said alignment protrusions fitting against sides of said receptacle to maintain said body centered with respect to said receptacle.

7. The latch apparatus according to claim 1, said alignment pins being offset with one another with respect to said second direction.

8. A latch apparatus for retaining a flexible circuit cable within a receptacle mounted on a circuit board, said latch apparatus comprising:

a latch body having a first planar side opposite a second planar side, said first planar side being parallel to said second planar side, said first planar side and second planar side being planar between a first end and a second end in a first direction and being planar between a first edge and a second edge in a second direction perpendicular to said first direction, said first direction and said second direction being parallel to said first planar side and said second planar side, said first end comprising a first handle extending perpendicularly from said first planar side, said second planar side comprising opposing alignment pins positioned at said first edge and said second edge of said second planar side, said second end comprising alignment protrusions extending from said second end in said first direction, said alignment protrusions extending from said second end at said first edge and said second edge and being parallel to said first edge and said second edge, said alignment protrusions being spaced apart from one another at a first spacing greater than a width of said flexible circuit cable, said first spacing being approximately equal to a width of said receptacle, said second end comprising clamping protrusions extending from said second end in said first direction, said clamping protrusions extending from said second end at said first edge and said second edge and being parallel to said first edge and said second edge, said clamping protrusions comprising clamping protrusion extensions extending from said second planar side, said clamping protrusion extensions positioning said clamping protrusions a distance from said alignment protrusions approximately equal to a thickness of said circuit board, a latch member extending from said second end, said latch member comprising a second handle extending from said latch member in a direction perpendicularly away from said first planar side, said latch member comprising a linear clip surface extending from said latch member in a direction perpendicularly away from said second planar side, and said linear clip surface running in said second direction and having a length less than said width of said receptacle.

9. The latch apparatus according to claim 8, said clamping protrusions being biased in a direction toward said alignment protrusions to clamp said circuit board between said clamping protrusions and said alignment protrusions.

10. The latch apparatus according to claim 8, said linear clip surface clipping against said receptacle to opposed forces opposite to said first direction.

11. The latch apparatus according to claim 10, a contact end of said flexible circuit cable being positioned to extend toward said second end of said body, said contact end of said flexible circuit cable being maintained within said receptacle by said linear clip surface clipping against said receptacle.

12. The latch apparatus according to claim 8, said alignment pins being maintained within circular notches of said flexible circuit cable.

13. The latch apparatus according to claim 8, said alignment protrusions fitting against sides of said receptacle to maintain said body centered with respect to said receptacle.

14. The latch apparatus according to claim 8, said alignment pins being offset with one another with respect to said second direction.

15. A latch apparatus for retaining a flexible circuit cable within a receptacle mounted on a circuit board, said latch apparatus comprising:

a latch body having a first planar side opposite a second planar side, said first planar side being parallel to said second planar side, said first planar side and second planar side being planar between a first end and a second end in a first direction and being planar between a first edge and a second edge in a second direction perpendicular to said first direction, said first direction and said second direction being parallel to said first planar side and said second planar side, said first end comprising a first handle extending perpendicularly from said first planar side, pressure applied to said first handle moving said body in said first direction and in a direction opposite said first direction to move said body toward and away from said circuit board and said receptacle, said second planar side comprising opposing alignment pins positioned at said first edge and said second edge of said second planar side, said second end comprising alignment protrusions extending from said second end in said first direction, said alignment protrusions extending from said second end at said first edge and said second edge and being parallel to said first edge and said second edge, said alignment protrusions being spaced apart from one another at a first spacing greater than a width of said flexible circuit cable, said first spacing being approximately equal to a width of said receptacle, said second end comprising clamping protrusions extending from said second end in said first direction, said clamping protrusions extending from said second end at said first edge and said second edge and being parallel to said first edge and said second edge, said clamping protrusions comprising clamping protrusion extensions extending from said second planar side, said clamping protrusion extensions positioning said clamping protrusions a distance from said alignment protrusions approximately equal to a thickness of said circuit board, a latch member extending from said second end, said latch member comprising a second handle extending from said latch member in a direction perpendicularly away from said first planar side, said latch member comprising a linear clip surface extending from said latch member in a direction perpendicularly away from said second planar side, said linear clip surface running in said second direction and having a length less than said width of said receptacle, and pressure on said second handle moving said linear clip surface in said direction perpendicularly away from said first planar side.

16. The latch apparatus according to claim 15, said clamping protrusions being biased in a direction toward said alignment protrusions to clamp said circuit board between said clamping protrusions and said alignment protrusions.

17. The latch apparatus according to claim 15, said linear clip surface clipping against said receptacle to opposed forces opposite to said first direction.

18. The latch apparatus according to claim 17, a contact end of said flexible circuit cable being positioned to extend toward said second end of said body, said contact end of said flexible circuit cable being maintained within said receptacle by said linear clip surface clipping against said receptacle.

19. The latch apparatus according to claim 15, said alignment pins being maintained within circular notches of said flexible circuit cable.

20. The latch apparatus according to claim 15, said alignment protrusions fitting against sides of said receptacle to maintain said body centered with respect to said receptacle.

* * * * *